United States Patent [19]

Forbes et al.

[11] Patent Number: 4,733,722

[45] Date of Patent: Mar. 29, 1988

[54] SHELL- AND TUBE-TYPE HEAT EXCHANGERS AND THEIR PRODUCTION

[75] Inventors: Murray K. Forbes; Robert Harwood, both of West Midlands; Stephen H. Carter, Peterborough, all of England

[73] Assignee: Serck Industries Limited, Birmingham, England

[21] Appl. No.: 865,175

[22] Filed: May 19, 1986

Related U.S. Application Data

[62] Division of Ser. No. 442,766, Nov. 18, 1982, abandoned.

[30] Foreign Application Priority Data

Nov. 20, 1981 [GB] United Kingdom ..... 8134972

[51] Int. Cl.[4] ..... F28F 9/22; F28F 9/06

[52] U.S. Cl. ..... 165/159; 165/158; 165/82; 165/76; 285/189; 285/137.1

[58] Field of Search ..... 165/159, 161, 162, 158

[56] References Cited

U.S. PATENT DOCUMENTS

| | | | |
|---|---|---|---|
| 2,101,167 | 12/1937 | De Baufre | 165/159 |
| 2,469,315 | 5/1949 | Shaw | 165/159 |
| 2,595,822 | 5/1952 | Uggerby | 165/159 |
| 2,941,787 | 6/1960 | Ramen | 165/157 |
| 3,151,674 | 10/1964 | Heller et al. | 165/158 |
| 3,228,456 | 1/1966 | Brown et al. | 165/159 |
| 3,732,922 | 5/1973 | Pouderoux | 165/158 |
| 3,812,907 | 5/1974 | Linning | 165/158 |
| 4,157,114 | 6/1979 | De Lorenzo | 165/158 |
| 4,207,944 | 6/1980 | Holtz et al. | 165/158 |
| 4,249,593 | 2/1981 | Bieberbach et al. | 165/158 |
| 4,415,020 | 11/1983 | Daugirda | 165/158 |

FOREIGN PATENT DOCUMENTS

| | | | |
|---|---|---|---|
| 620675 | 5/1961 | Canada | 165/159 |
| 2828275 | 1/1980 | Fed. Rep. of Germany | 165/159 |
| 682861 | 11/1952 | United Kingdom | 165/159 |
| 757633 | 9/1956 | United Kingdom | 165/159 |

*Primary Examiner*—Albert W. Davis, Jr.

*Attorney, Agent, or Firm*—Trexler, Bushnell, Giangiorgi & Blackstone, Ltd.

[57] ABSTRACT

A casing for a shell- and tube-type heat exchanger is produced by deforming two axially spaced portions of a length of tubing to make their integral peripheries either larger than or smaller than the internal periphery of an intermediate portion of the casing which is interposed between the end portions. A tubestack comprising tube elements supported by tubeplates is received within the casing, with the tubeplates being disposed at least partially within the end portions respectively. In the case where the natural bore of the tubing (which forms the internal periphery of the intermediate casing portion) is accurately sized and one of the end portions has a larger internal periphery than said bore, transverse baffles of the tubestack can have external peripheries which are accurately sized to engage the internal periphery of the intermediate casing portion. Otherwise, the baffles can have flexible tires mounted on their peripheries to engage the internal periphery of the intermediate casing portion. Where the internal bore of the tubing is subject to known dimensional tolerances such that it has a maximum and a minimum possible size, the end portions of the casing are deformed so that their internal peripheries are either larger than said maximum possible bore size or smaller than said minimum possible bore size.

9 Claims, 14 Drawing Figures

SHELL- AND TUBE-TYPE HEAT EXCHANGERS AND THEIR PRODUCTION

This is a divisional of co-pending application Ser. No. 442,766 filed on Nov. 18, 1982 now abandoned.

This invention relates to shell and tube type heat exchangers and their production.

A conventional shell and tube type heat exchanger is shown in longitudinal cross-section in FIG. 1 of the accompanying drawings. The heat exchanger comprises generally a tubular shell or casing 10 having a pair of inlet/outlet pipes 11 and 12 through which a first fluid is passed, and a tubestack 13 received within the casing. The tubestack is composed of generally parallel tube elements 14 through which a second fluid is passed for heat exchange with the above-mentioned first fluid, the tube elements extending between and being supported by a pair of support members or tubeplates 15 and 16. The tubestack 13 also includes a plurality of baffles 17 disposed between the tubeplates 15,16 and extending transversely to the tube elements 14. The second fluid is supplied to the tubestack 13 by means of inlet/outlet ports 18 and 19 in respective covers 20 and 21 which are secured to the casing 10 by any convenient means, such as by bolted flanges or bolt and lug arrangements (not illustrated) provided on these parts. To prevent intermixing of first and second fluids, at one end of the heat exchanger a suitable sealing arrangement 22 surrounding the tubeplate 15 is interposed between the cover 20 and the casing 10, whilst at the other end of the heat exchanger the tubeplate 16 is provided with an extended flange 23 carrying respective packings 24 and 25 likewise disposed between the cover 21 and the casing 10. The flange 23 also serves as an abutment relative to casing 10 and serves to locate the tubestack 13 axially within the casing.

In the above-described construction the baffles 17 serve to control in a desired manner the flow pattern of the first fluid over the tubes as it passes through the casing. For simplicity, the baffles are shown as plain plates though in practice first apertures are provided to receive the tube elements together with second apertures to permit passage of the first fluid from one side of the baffle to the other. In one known construction, the baffles consist of plates whose external peripheries closely conform to the internal bore of the casing and which have a centrally positioned second aperture, and plain plates of reduced external diameter with respect to the casing bore, the two types of plate being arranged alternately along the casing. For those baffle plates which closely conform to the casing bore it is important to achieve a minimum clearance between their external peripheries and the internal periphery of the casing to minimise by-pass of the first fluid between these parts, and thereby enable the maximum thermal performance of the heat exchanger to be obtained.

Customarily, this minimum clearance is achieved by known means such as machining the bore of the casing 10 to closely controlled dimensions with complementary control of the external periphery of each baffle. Usually this necessitates producing the casing by casting or manufacturing it from thick-walled tubing, both of which require a costly through-boring operation to obtain the required dimensional accuracy. Alternatively the casing can be manufactured from commercially available tubing as it stands, the tubestack 13 being machined to conform to the actual bore of the piece of tube used for the casing. Unfortunately this means that each tubestack is unique to its casing and therefore the tubestack cannot be used interchangeably with other similar casings and equally the casing cannot be used interchangeably with other similar tubestacks. Accordingly if service replacements are required for either casing or tubestack these have to be specially manufactured to specific dimensions. A further alternative is to produce the casing from tubing drawn to closely specified dimensional bore tolerances but this incurs a disadvantageous costly penalty.

The provision of a close dimensional relationship between the internal periphery of the casing and the external periphery of any baffle can also cause problems where the tubestack is intended to be removable from the casing so that after a period in service it can be extracted for inspection and cleaning. In this case, the accumulation of deposits on the internal walls of the casing can seriously impede the withdrawal of the tubestack from the casing, and in extreme cases damage can result.

Should the casing 10 shown in FIG. 1 made from tubing, a further disadvantage appears due to the manner in which the inlet/outlet pipes 11 and 12 are provided. Conventionally this is done by cutting an opening of appropriate size in the casing wall and then welding a piece of pipe about or into the said opening. Normally such welding of the pipes to the casing wall causes localised distortion of the internal periphery of the casing, and requires either localised dressing by grinding or through-bore machining to be rectified.

It is an object of the present invention to obviate or mitigate the problems and disadvantages described above.

According to a first aspect of the present invention, a heat exchanger comprises a hollow casing through which a first fluid is passed and which includes a pair of tubular end portions and a tubular intermediate portion axially interposed between the end portions, each of the end portions having an internal periphery which is either smaller than or larger than the internal periphery of the intermediate portion, and a tube stack received within the casing and including a plurality of tube elements through which a second fluid is passed for heat exchange with said first fluid and a pair of support members between which the tube elements extend, the support members being disposed at least partially within the end portions of the casing respectively.

In one particular arrangement, the casing is formed from tubing whose internal bore is subject to known dimensional tolerances such that it has a maximum possible size and a minimum possible size, the internal periphery of the intermediate portion being formed by the natural bore of the tubing. In this case, it is preferred that the internal periphery of one of the end portions is smaller than said minimum possible size of the bore, and the internal periphery of the other end portion is either smaller than said minimum possible size of the bore or larger than said maximum possible size of the bore. Where the tube stack also includes at least one baffle extending transversely of the tube elements and disposed between the support members, the baffle or at least one of the baffles (as the case may be) can have a flexible outer periphery which engages the internal periphery of the intermediate portion of the casing. In this way, a close dimensional relationship is ensured between the internal periphery of the intermediate portion of the casing and the external periphery of the baffle by virtue or the flexible nature of the latter, irrespective of the actual bore size of the tubing from which the casing is made.

In an alternative arrangement, the casing is formed from tubing whose internal bore is accurately sized, the internal periphery of the intermediate portion being formed by the natural bore of said tubing. The internal peripheries of both end portions of the casing may be smaller in size than the internal periphery of the intermediate portion, or alternatively one or both of the end portions can have a larger internal periphery than said intermediate portion. Where the tubestack also includes at least one baffle extending transversely to the tube elements and disposed between the support members, in the first of the above cases the baffle or at least one of the baffles (as the case may be) can be provided with a flexible outer periphery in the manner described previously, while in the second of the above cases the baffle or at least one of the baffles (as the case may be) can have an accurately-sized external periphery which engages the internal periphery of the intermediate portion or, as mentioned above, it can have a flexible outer periphery.

In the case where the baffle has a flexible outer periphery, the latter is preferably constituted by an annular flexible member which includes a base portion and at least one flexible arm portion extending outwardly from the base portion, the or each flexible arm portion engaging the internal periphery of the casing. The annular flexible member can include two such arm portions extending from he base portion in opposite directions transversely to the baffle. Advantageously, the free end of the or each arm portion is curved radially inwardly of the baffle, and more particularly may take the form of a hook or a bead. Where the casing is formed from tubing whose internal bore is subject to known dimensional tolerances as aforesaid, the base portion preferably has an outwardly-facing surface which is smaller in its extent than the minimum possible size of the bore, and the or each arm portion in its relaxed state has a maximum radial extent which is not less than the maximum possible size of the bore.

At least one (and preferably both) of the extreme ends of the casing may be flared outwardly, desirably at an included angle of substantially 90°.

Preferably, inlet and outlet ports for the first fluid are formed in the casing, and supply pipes are secured to the casing for passage of the first fluid to and from the inlet and outlet ports respectively, the inlet and outlet ports being formed in the casing and the supply pipes being secured to the casing in such a manner that there are no parts which project into the internal cross-section proper of the casing. In this way, it can be ensured that there are no obstructions in the interior of the casing which will interfere with insertion or removal of the tubestack.

In one particular arrangement, at least one of the inlet and outlet ports is formed by locally deforming the casing outwardly to produce a stub-pipe, and the respective supply pipe is secured to the stub-pipe. In a second arrangement, a part of the casing which surrounds at least one of the inlet and outlet ports is bulged outwardly and has a generally planar surface in which said part is formed, and the respective supply pipe (which may have a plain or flanged end) is secured to said generally planar surface.

According to a second aspect of the present invention, a method of producing a casing for a heat exchanger comprises providing tubing having an internal bore and deforming two axially spaced tubular portions of the tubing such that the internal periphery of each said portion is either smaller than or larger than said internal bore, said two tubular portions being separated by a portion of the natural tubing.

The internal bore of the tubing may be accurately sized or may be subject to known dimensional tolerances such that it has a maximum and a minimum possible size. In the latter case, each of said two tubular portions is deformed such that its internal periphery is either smaller than the minimum possible size of the internal bore or larger than the maximum possible size of the internal bore.

The method conveniently also comprises the step of flaring outwardly at least one (and preferably both) of the extreme ends of the tubing.

The invention will now be further described, by way of example, with reference to the remaining figures of the accompanying drawings, in which.

Figure 2:
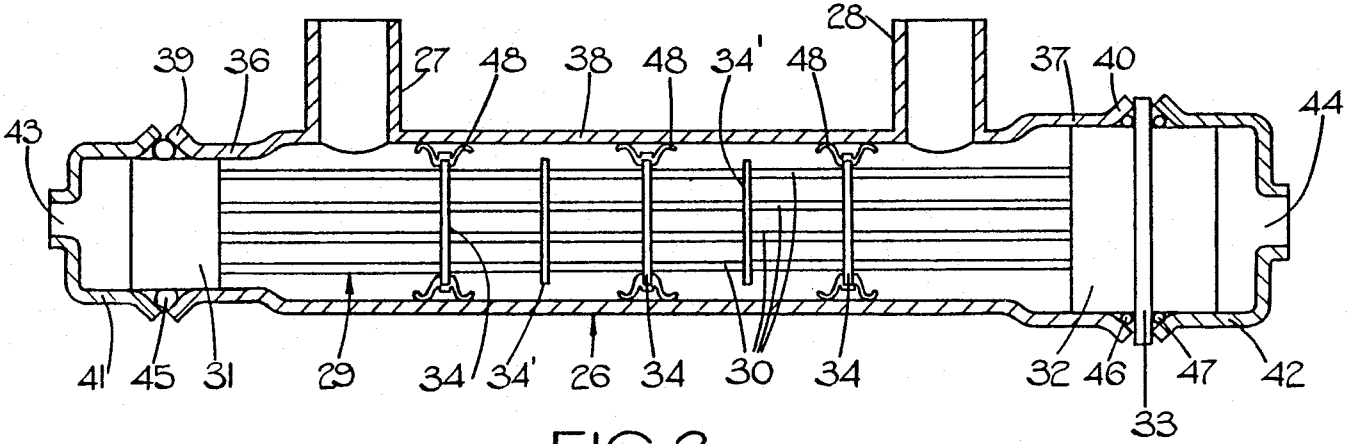
FIG. 2 is a longitudinal sectional view of a first embodiment of a heat exchanger according to the present invention.

Referring first to FIG. 2, the heat exchanger shown therein like the conventional construction described above comprises a hollow tubular casing 26 through which a first (shell-side) fluid is passed by means of inlet/outlet pipes 27 and 28. A tubestack 29 is received within the casing 26 and includes a plurality of generally parallel tube elements 30 through which a second (tube-side) fluid is passed for heat exchange with the shell-side fluid. The tube elements 30 extend between and are supported by a pair of tubeplates 31 and 32, the tubeplate 32 having a flange 33 on its external periphery which engages an end of the casing 26 and thereby locates the tubestack 29 axially within the casing. A plurality of baffles 34 are disposed between the tubeplates 31, 32 and extend transversely to the tube elements 30 to control the flow pattern of the shell-side fluid through the interior of the casing 26. In the embodiment actually illustrated, alternate ones of the baffles have a central aperture therein (not shown) through which the shell-side fluid flows in use, while the intermediate baffles (referenced 34') each have an external periphery which is rather smaller than the internal periphery of the casing, such that an annular space is defined between each baffle 34' and the casing through which the shell-side fluid can flow. In this way, a convoluted flow pattern of the shell-side fluid is obtained to increase the heat transfer efficiency of the heat exchanger.

Figure 3:
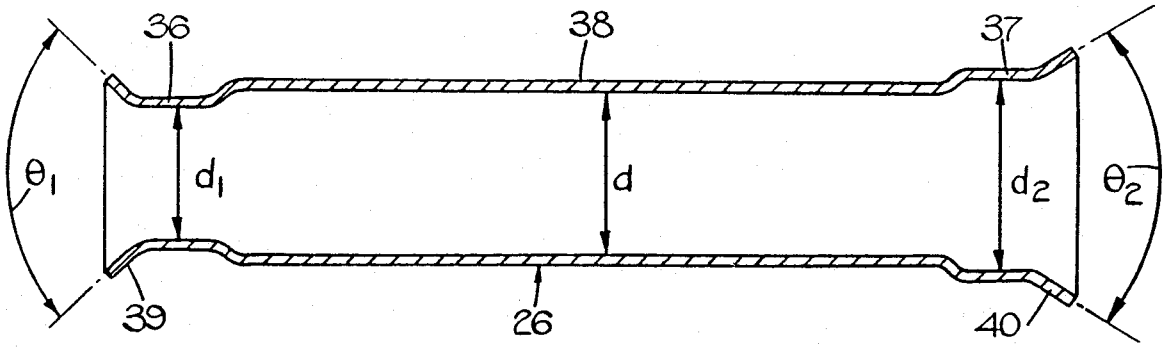
FIG. 3 is a longitudinal sectional view of a casing which forms part of the heat exchanger shown in FIG. 2.

In this embodiment, the casing 26 is formed from readily commercially available tubing whose internal bore is subject to known dimensional tolerances in its diameter d (see FIG. 3), such that the diameter d has a maximum possible value and a minimum possible value having regard to these tolerances. Typically, such a tubing has a $\pm 1\%$ tolerance on its external diameter and as much as $\pm 15\%$ tolerance on its wall thickness, so that for example in a random batch of tubes having a nominal external diameter of 10 ins. and a nominal wall thickness of ¼in., the diameter of the internal bore may vary from tube to tube by as much as ¼in. or more. The magnitude of this variation usually becomes greater with increasing tube diameter and less with decreasing diameter. The tubing employed may be seamless, or may be seamed by either longitudinal or helical welding.

During manufacture of the casing 26, a tubular portion 36 adjacent one end of the tubing is deformed inwardly by a conventional rolling, swaging or flow forming technique such that its internal diameter $d_1$ is accurately sized to a value less than the minimum possible diameter of the tubing bore, while a tubular portion 37 adjacent the other end of the tubing is similarly deformed outwardly such that its internal diameter $d_2$ is accurately sized to a value greater than the maximum possible diameter of the tubing bore. A tubular intermediate portion 38 disposed axially between the portions 36 and 37 retains the natural bore diameter of the tubing. Preferably, the portions 36, 37 and 38 are all coaxial, as illustrated. It will be appreciated from FIGS. 2 and 3 that smooth transitions are achieved between the various different internal diameters of the casing. An outboard end 39 of the portion 36 is flared outwardly at an included angle of $\theta_1$, while an outboard end 40 of the portion 37 is similarly flared outwardly at an included angle of $\theta_2$, $\theta_1$ and $\theta_2$ being substantially 90° in the illustrated construction. Such flaring of the end portions 39 and 40 serves to stiffen the casing ends and also enables sealing packings to be accommodated in a manner to be described later. The axial lengths of the portions 36,37 and their respective ends 39,40 accord with the overall design requirements of the heat exchanger.

Referring back to FIG. 2, the ends of the casing 26 are closed by respective covers 41 and 42 having therein respective inlet/outlet ports 43 and 44 for the tube-side fluid. A sealing packing 45 is axially interposed between the cover 41 and the flared end 39 of the casing 26, and also seals against the external periphery of the tubeplate 31. Another sealing packing 46 is received between the flared end 40 of the casing and the flange 33 on the tubeplate 32, while a further sealing packing 47 is received between the flange 33 and the cover 42.

Figure 1:
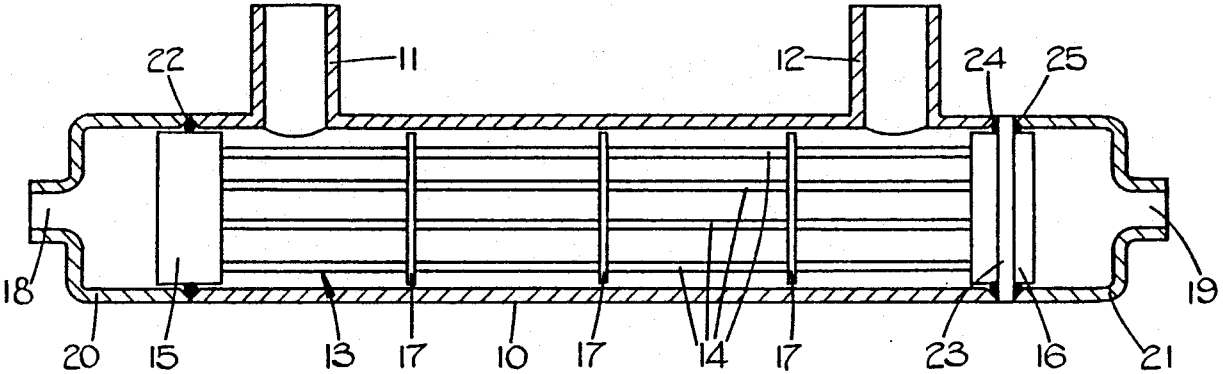
FIG. 1. PRIOR ART

The tubeplates 31 and 32 of the tubestack 29 are dimensioned so that they are received with suitable clearance within the portions 36 and 37 respectively when the tubestack is fully inserted in the casing 26, any resultant gaps being sealed by the sealing packings 45, 46 and 47. The baffles 34 and 34' on the other hand are received within the intermediate portion 38 of the casing. Where the tubestack is to be interchangeable between different casings, if the baffles 34 were to take the conventional form shown in FIG. 1 then their external dimensions would have to be no greater than the minimum possible diameter of the tubing bore, or else it might not be possible for the baffles to be accommodated within the casing portion 38. However, in the event that the diameter of the tubing bore is near its maximum possible value, there will be substantial gaps between the external peripheries of the baffles and the internal periphery of the casing portion 38, with the result that substantial by-pass of the shell-side fluid will be possible.

Figure 4:
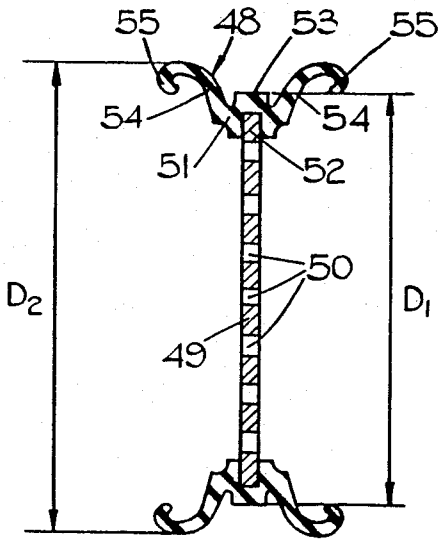
FIG. 4 is a sectional view of a baffle which also forms part of the heat exchanger shown in FIG. 2.

In order to overcome this problem, each baffle 34 is provided with a flexible rim which enables it to conform to the bore diameter of the tubing from which the casing is produced. One example of such a baffle is shown in FIG. 4, wherein an elastomeric tire 48 is mounted on the periphery of a baffle plate 49. Apertures in the baffle plate 49 through which the tube elements 30 respectively pass are referenced 50 in this Figure. The tire 48 comprises an annular base portion 51 having a groove 52 in its internal periphery within which the outer edge of the baffle plate 49 is received, the base portion 51 also having a radially outwardly facing peripheral surface 53. A pair of flexible arms 54 extend radially outwardly from the base portion 51 in opposite transverse directions with respect to the baffle plate 49 at a desired included angle, usually between 30° and 90°, and terminate at their free ends in respective rounded hook formations 55 which are directed generally radially inwardly of the baffle. The tire is dimensioned so that, when it is fitted on the baffle plate 49, the diameter $D_1$ of the surface 53 is less than the minimum possible diameter of the tubing bore and approximately the same as the diameter of the tubeplate 31, and the outermost diameter $D_2$ of the flexible arms 54 when in their relaxed state is not less than the maximum possible diameter of the tubing bore, preferably slightly more than the latter. In addition, the proportions of the base portion 51 are such that it does not obscure the outermost tube apertures 50 when fitted to the baffle plate 49, and such that under any combination of induced vibration or gravitational effects (such as are encountered with a long heat exchanger mounted horizontally) there is no likelihood of the baffle plate shearing through the tire. The tire 48 may be formed by an extruded section cut to length with its ends joined to form a ring, or may be moulded as a ring in the first instance.

Figure 5:
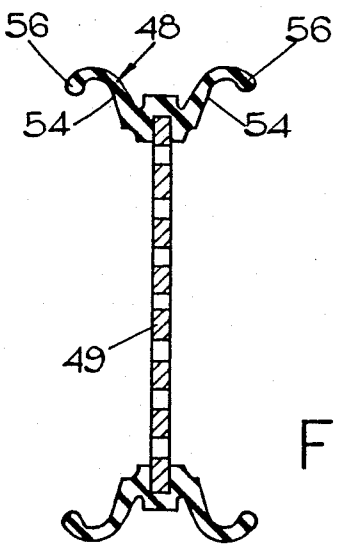
FIG. 5 is a sectional view of a modified form of baffle.

An alternative form of baffle is shown in FIG. 5, being generally similar to that described above with reference to FIG. 4, except that the hook formations 55 at the free ends of the flexible arms 54 are replaced by rounded heads 56 again directed generally radially inwardly of the baffle.

Typically, during insertion of the tubestack 29 into the casing 26, the flexible rim of each baffle in turn first engages the flared end 40 and then engages within the enlarged casing portion 37 and subsequently within the casing portion 38. The flared nature of the end 40 together with the smooth transition between the casing portions causes the flexible arms 54 of the tire 48 to deform radially inwardly of the baffle without posing any substantial resistance to the insertion of the tubestack. The rounded ends of the arms 54 provided by the hook formations 55 or the beads 56 greatly assists such insertion because it prevents the advancing edge of each tire 48 from digging into the side walls of the casing portions 37 and 38.

When the tubestack 29 is fully inserted within the casing 26, the natural resilience of the tires 48 maintains the arms 54 in contact with the internal periphery of the casing portion 38, thereby substantially or entirely eliminating by-pass of the shell-side fluid. Moreover, as the shell-side fluid flows through the interior of the casing it creates a higher pressure on one side of each baffle 34 than on the other side thereof, which causes the arm 54 on the higher pressure side of the respective tire 48 to be pushed outwardly against the internal wall of the casing portion 38, thereby assisting the sealing action of the tire. The arm 54 is, however, sufficiently rigid to prevent its being forced between the base portion 51 of the tire and the casing wall.

If in service fouling deposits accumulate on the internal walls of the casing 26, withdrawal of the tubestack 29 for inspection or replacement is not impeded because the rounded ends of the arms 54 enable the latter to ride up and over any such deposits. The arms 54 will similarly ride across the various openings in the casing (i.e. the openings of the inlet/outlet pipes 27 and 28 for the shell-side fluid, fluid drains, vents, inspection holes, etc.) and due to their rounded ends will not fold back or suffer damage even if these openings are quite sharp. In the event that the tires 48 do become damaged or suffer deterioration, they can easily be replaced. As mentioned above, the manner in which the inlet/outlet pipes 27 and 28 are produced may give rise to localised distortion of the casing walls: however, by providing the baffles with flexible rims as described above, such distortion can be accepted without the need to machine the interior of the casing.

In the heat exchanger described above, the casing 26 can be made at low cost from relatively inexpensive tubing, while the provision of flexible rims on the baffles ensures high thermal performance by substantially preventing by-pass of the shell-side fluid, and at the same time permits removal of the tubestack 29 in service. A further advantage of the flexible rim baffle is its ability to minimise the transmission of externally induced vibrations to the tube elements 30 via the casing and baffles. Moreover, because the interior dimensions of the casing are produced by forming as opposed to through-boring, thinner walled tubing can be utilised thereby contributing to a reduction in the overall weight of the heat exchanger. Although the casing thus has a reduced wall thickness as compared with conventional constructions, its stiffness is enhanced by the flaring of its ends, as described previously.

Figure 6:
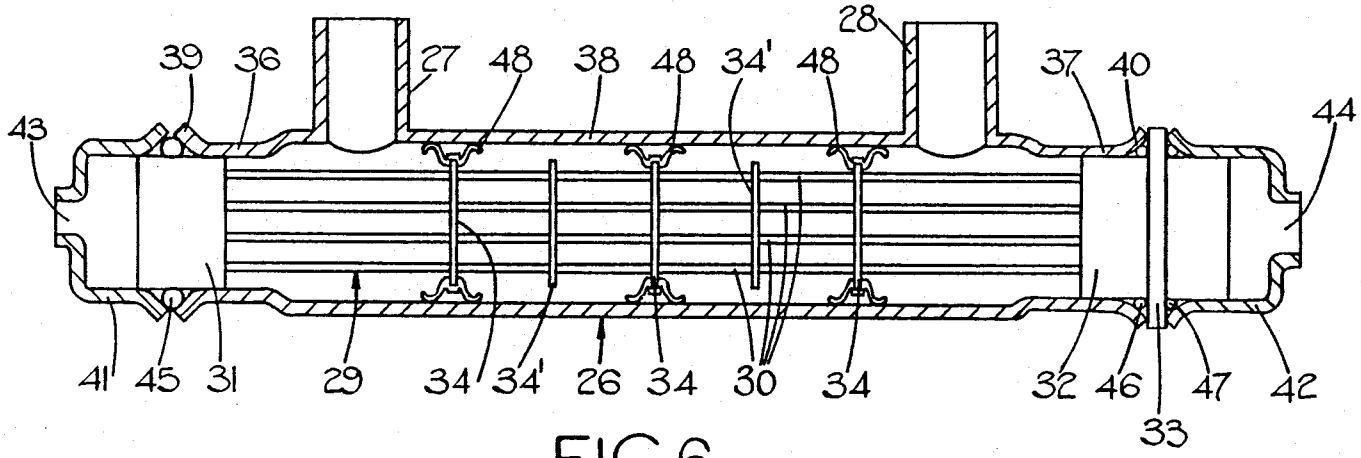
FIG. 6 is a longitudinal sectional view of a second embodiment of a heat exchanger according to the present invention.

FIG. 6 illustrates a second embodiment of a heat exchanger according to the invention which is generally similar to the construction described above with reference to FIGS. 2 to 5, similar parts being accorded the same reference numerals. In this embodiment, however, the portion 37 of the casing 26 is deformed inwardly rather than outwardly, and its internal diameter is accurately sized to a value smaller than the minimum possible diameter of the tubing bore, preferably the same as the internal diameter of the casing portion 36. In this latter case, the tubeplates 31 and 32 of the tubestack 29 have the same external dimensions, and the baffles 34 are sized so that they can pass easily through the portion 37 during insertion of the tubestack within the casing.

Figure 7:
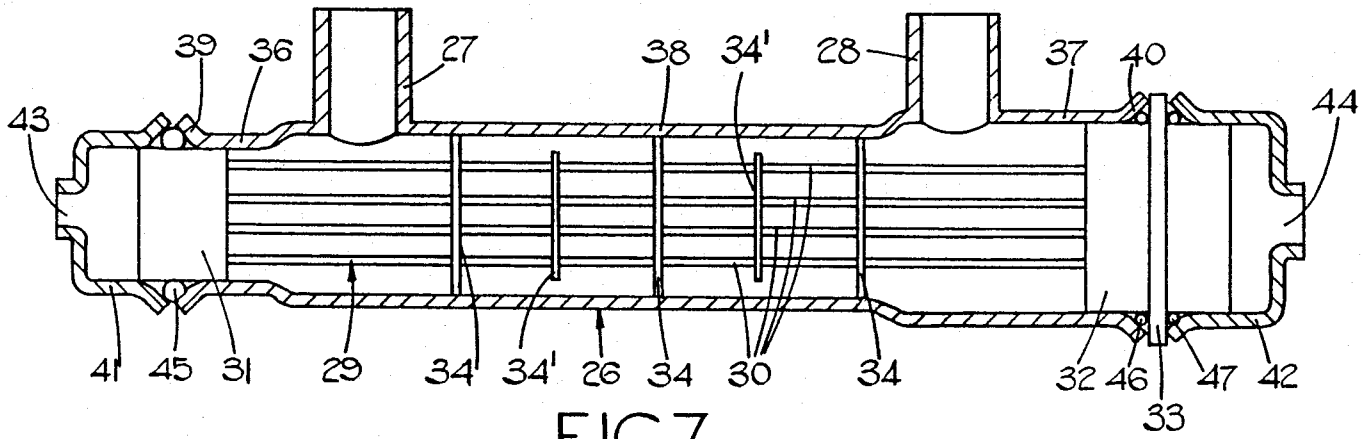
FIG. 7 is a longitudinal sectional view of a third embodiment of a heat exchanger according to the present invention.

In the embodiment shown in FIG. 7, the casing 26 is formed from tubing whose bore diameter is accurately sized during its manufacture. As in the embodiment of FIG. 2, the casing comprises portions 36, 37 and 38 whose internal diameters are respectively less than, greater than and equal to the natural bore diameter of the tubing. However, the baffles 34 are now of conventional form, i.e. they do not have flexible rims, and their external dimensions are accurately machined so as to be complementary to the internal dimensions of the casing portion 38. In order that insertion and withdrawal of the tubestack 29 is not obstructed by any welding distortions which may be present in the casing in the region of the inlet/outlet pipe 28, the enlarged portion 37 of the casing is now extended axially to just short of the final position of the baffle 34 nearest to the tubeplate 32. The resultant enlarged internal diameter of the casing in the region of the pipe 28 enables the baffles 34 readily to pass by any such distortions. Any welding distortions in the region of the other inlet/outlet pipe 27 will not affect insertion of the baffles 34 in the casing since the opening of the pipe 27 is disposed beyond the final position of the foremost baffle. Equally, such distortions will not impede insertion of the tubeplate 31 because the latter is of a lesser diameter than the interior of the casing in the vicinity of the pipe 27 and will readily pass under the distortions.

The embodiment of FIG. 7 thus permits easy insertion and withdrawal of the tubestack without the need to perform a through-boring operation on the interior of the casing. Although use is made of tubing produced to very close tolerances which is generally more expensive than the tubing utilised in the previous embodiments, its cost can be offset by taking advantage of the closely controlled bore diameter to obviate the need for flexible rims on the baffles.

In a modification (not shown) of the embodiment of FIG. 7, the portion 36 instead of being reduced is enlarged so that its internal periphery is larger than the natural bore of the tubing from which the casing 26 is formed. In this case, the tubeplate 31 has the same external size as the baffles 34, and the disparity between the external size of the tubeplates 31 and the internal size of the casing portion 36 is accommodated by the sealing packing 45 to prevent leakage of the shell- and tube-side fluids past the tubeplate 31. In a further modification (also not shown), both of the casing portions 36 and 37 are reduced such that their internal peripheries are smaller in size than the natural bore of the tubing from which the casing is formed. In this case, because the baffles 34 must be small enough to pass through the reduced portion 37, they must be provided with flexible rims as described above to ensure that a seal can be formed between their outer peripheries and the internal periphery of the casing portion 38.

Figure 8:
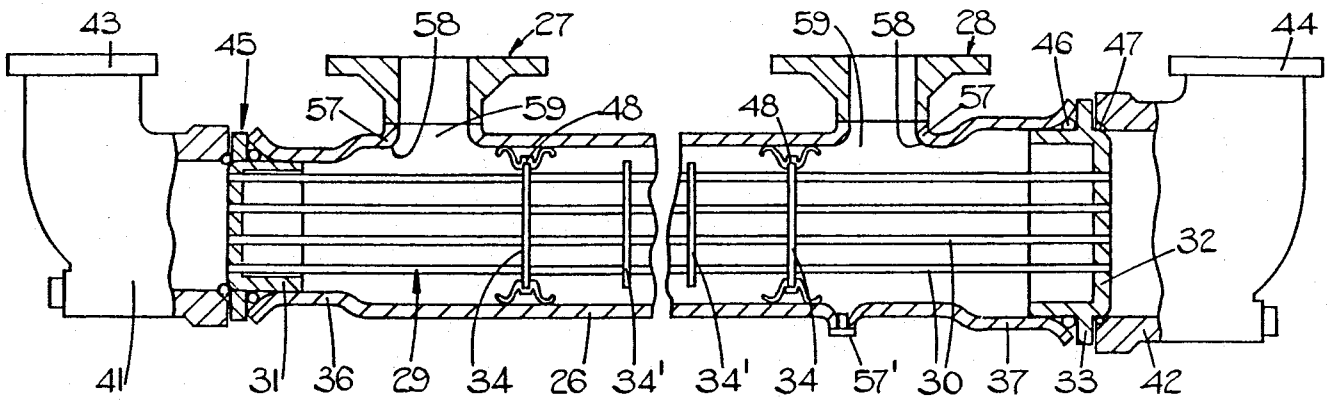
FIG. 8 is a part longitudinal sectional view of a fourth embodiment of a heat exchanger according to the present invention, illustrating one form of an inlet/outlet pipe thereof.

In the above description, it has been assumed that the inlet/outlet pipes 27 and 28 are simply welded in position on the casing exterior. However, as mentioned previously, such welding can lead to localised distortions which may obstruct insertion and removal of the tubestack 29. FIG. 8 illustrates one example of a modification by means of which this problem can be avoided in relation to each of the pipes 27 and 28. During the manufacture of the casing 26 as described previously, a small hole is pierced through the casing wall in a desired position and is then enlarged (for example by swaging of flow forming) to produce an outwardly-directed stub-pipe 57 having smoothly radiussed corners 58, which pipe 57 defines a port 59 communicating with the interior of the casing. The inlet/outlet pipe 27 or 28 is then secured to the stub-pipe 57 by any convenient means (such as by welding) so that its interior communicates with the port 59. The port 59 associated with the inlet/outlet pipe 27 may be provided in the intermediate casing portion 38 as illustrated or may instead be formed in the casing portion 36, while the port associated with the inlet/outlet pipe 28 may similarly be provided in either of the portions 37 and 38 of the casing, such that interference with the sealing action of the baffles 34 (whether plain or tired) is avoided. The provision of the radiussed corners 58 greatly assists the passage of the tubeplate 31, the baffles 34 and the tires 48 (when provided) through the casing when the tubestack is inserted or removed. The above technique of forming a stub-pipe may also be employed in relation to other openings in the casing: for example, by internally threading the stub-pipe to receive a correspondingly screwed plug, the technique may be applied to venting and drainage openings for the shell-side fluid as indicated at 57'.

Figure 10:
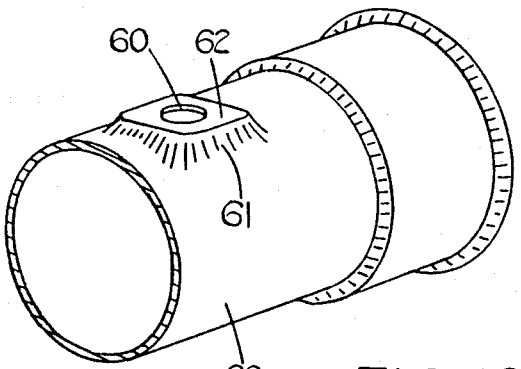
FIG. 10 is a perspective view of the part of the casing shown in FIG. 9.
Figure 9:
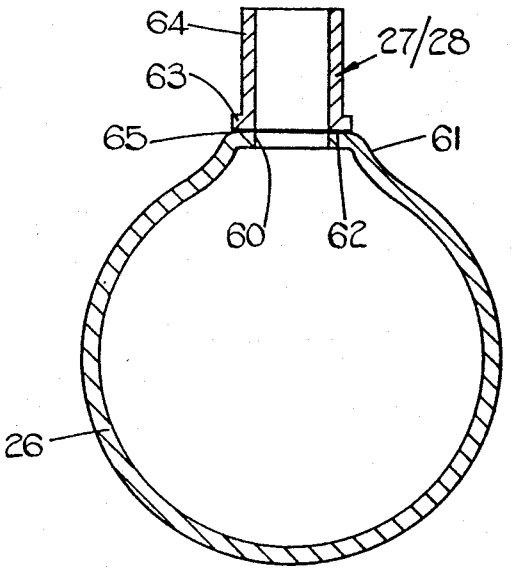
FIG. 9 is a cross-sectional view of another form of inlet/outlet pipe and a part of the heat exchanger casing on which it is mounted.
Figure 11:
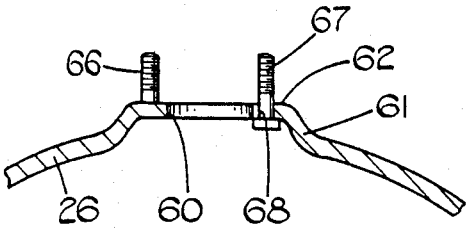
FIG. 11 is a sectional view illustrating the manner in which the inlet/outlet pipe shown in FIG. 9 is connected to the casing.

A second modification of the connection for the inlet/outlet pipe is shown in FIGS. 9 to 11, the parts thereof which are similar to those previously described being accorded the same reference numerals. The casing 26 is now bulged outwardly in the vicinity of an inlet/outlet port 60 to form a localised blister 61 having a flat surface 62. The inlet/outlet pipe 27 or 28 is composed of a flange portion 63 having an aperture which is aligned with the port 60 in the casing 26, and a tubular portion 64 whose interior communicates with the aperture in the flange portion 63. A sealing gasket 65 (which may take the same form as the gasket described below in relation to FIGS. 12 to 14) is interposed between the flange portion and the casing exterior. The pipe can be secured to the blister 61 by means of threaded studs 66 welded to the casing exterior (as indicated in the left-hand part of FIG. 11) or by means of headed bolts 67 (only one shown) sealingly secured in respective holes 68 drilled into the flat surface 62 (as indicated in the right-hand part of FIG. 11). Such securement of the bolts can be by welding or brazing, for example. The outward bulge of the blister 61 prevents the heads of the bolts 67 from intruding into the internal cross-section proper of the casing and interfering with the insertion of the tubestack or any part thereof. The provision of the blister 61 is advantageous in that, being integral with the casing 26, it is rigid and there is little or no weakening of the structure such as would be caused by welding together separate components as previously described in providing the inlet/outlet pipes for the shell-side fluid. A further advantage is that the inlet/outlet pipes may be directly incorporated in the connecting pipework for the shell-side fluid, thereby providing a saving in the space required for its installation. Blisters similar to that described above can be provided elsewhere on the casing for other purposes. For example, such blisters without any port but with securing means can be employed as mounting faces or pads for co-operation with other faces or pads at the place of installation of the heat exchanger. Additionally or alternatively, such blisters may be utilised as inspection points and may have the port closed by a blanking plate. The blisters can be provided at any convenient position on the casing in relation to the tubestack 29. For example, they can be situated between the tubeplates 31 and 32 and their respective closest baffles 34, or between adjacent ones of the baffles themselves such that interference with the sealing action of the tires 48 (when provided) is avoided.

Figure 12:
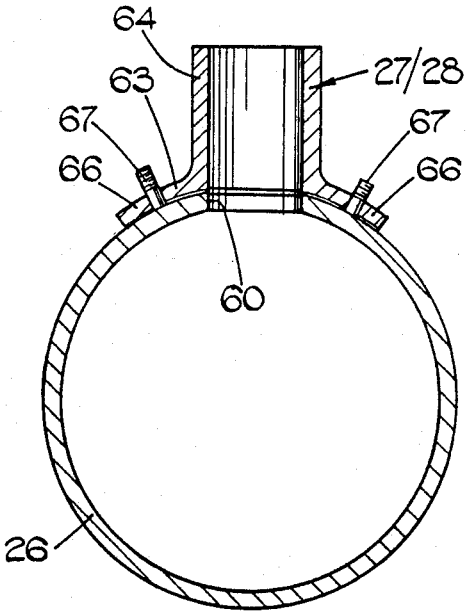
FIG. 12 is a cross-section of a further form of the inlet/outlet pipe and part of the heat exchanger casing on which it is mounted.
Figure 13:
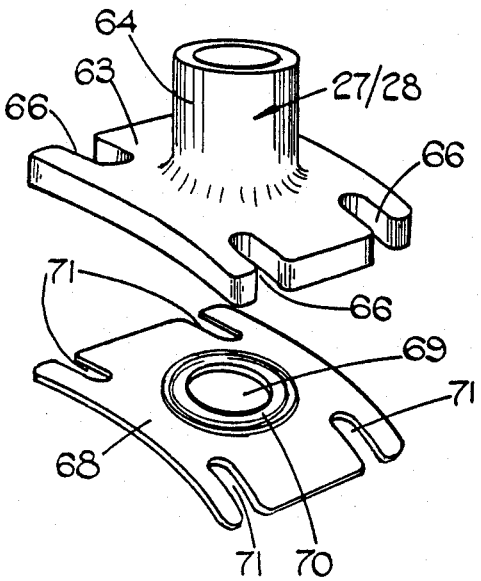
FIG. 13 is a perspective view of the inlet/outlet pipe shown in FIG. 12 and a seal therefor.
Figure 14:
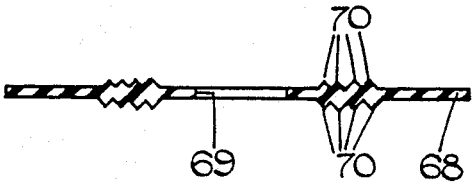
FIG. 14 is a sectional view of the seal shown in FIG. 13.

A third modification of the connection of the inlet/-outlet pipe is shown in FIGS. 12 to 14, the parts thereof which are similar to those described in the first and second modifications being accorded the same reference numerals. As in the second modification, the pipe comprises a flange portion 63 and an integral tubular portion 64 aligning with the inlet/outlet port 60 in the casing 26. In this modification, however, the port 60 is formed by a generally plain aperture in the casing 26, and the flange portion 63 is of arcuate configuration such that it conforms to the external shape of the casing 26. The flange portion 63 has either slots 66 (as shown) or holes in opposed edges thereof, and the pipe 27 and 28 is secured to the casing by means of threaded studs 67 welded to the casing exterior and extending radially thereof, the studs being received by the slots 66 respectively and having corresponding washers and nuts (not shown) attached thereto. A sealing gasket 68 is interposed between the flange portion 63 and the casing exterior and has an aperture 69 therein which is aligned with both the inlet/outlet port 60 in the casing and the aperture in the flange portion. A number of annular serrations 70 surround the aperture 69 on both sides of the gasket 68 and serve to improve the sealing capability of the latter, particularly where surface irregularities are present on both the casing exterior and the underside of the flange portion 63. As can be seen to advantage in FIG. 13, the gasket 68 in plan conforms to the shape of the flange portion 63, and in a preferred form has either slots 71 (as shown) or holes through which the studs 67 respectively pass.

What is claimed is:

1. A heat exchanger comprising a hollow casing through which a first fluid is passed, and a tubestack received within the casing and including a plurality of tube elements through which a second fluid is passed for heat exchange with said first fluid, the tubestack also including at least one baffle, extending transversely to the tube elements and a flexible annular member provided around the whole periphery of said at least one baffle, the flexible annular member having a base portion defining an annular groove which embraces an outer edge part of said baffle and which sealingly engages in a fluid-tight manner said outer edge part of the baffle and a pair of circumferentially continuous arm portions which extend in opposite axial directions from the base portion and which, in use, resiliently sealingly engage in a fluid-tight manner an internal surface of the hollow casing, a free end of each arm portion being curved radially inwardly of the baffle, such that the engagement of the arm portions with the casing internal surface further enhances the sealing engagement between the annular groove and the baffle edge part.

2. A heat exchanger as claimed in claim 1, wherein the free end of each arm portion has the form of a hook.

3. A heat exchanger as claimed in claim 1, wherein the arm portions extend at an included angle of between 30 degrees and 90 degrees.

4. A heat exchanger as claimed in claim 2, wherein the arm portions extend at an included angle of between 30 degrees and 90 degrees.

5. A heat exchanger as claimed in claim 1 wherein the free end of each arm portion has the form of a bead.

6. A heat exchanger as claimed in claim 5 wherein the arm portions extend at an included angle of between 30 degrees and 90 degrees.

7. The heat exchanger according to claim 1, wherein said hollow casing has two extreme ends, at least one of which is flared outwardly.

8. The heat exchanger according to claim 7, wherein said at least one extreme end is flared outwardly at an included angle of substantially 90 degrees.

9. The heat exchanger according to claim 8 and further including at least one cover member for closing said at least one outwardly flared extreme end and a sealing packing interposed between said cover and said least one outwardly flared extreme end.

* * * * *